US005158429A

United States Patent [19]

Chiang et al.

[11] Patent Number: 5,158,429

[45] Date of Patent: Oct. 27, 1992

[54] SELF-CONTAINED CLEANING SYSTEM FOR SMOKE EXHAUSTERS

[76] Inventors: Chao-Cheng Chiang; Chi-Shyong Chiang, both of 9-1, Lane 161, Hsing An Road Sec. 1, Taichung, Taiwan

[21] Appl. No.: 736,479

[22] Filed: Jul. 26, 1991

[51] Int. Cl.[5] ..... F01D 15/08

[52] U.S. Cl. ..... 415/121.3; 126/299 E; 134/181; 415/206; 454/354

[58] Field of Search ..... 415/117, 121.3, 206, 415/203; 134/172, 180, 181; 126/299 E; 454/341, 354; 98/42.02, 42.07

[56] References Cited

U.S. PATENT DOCUMENTS

| | | | |
|---|---|---|---|
| 1,954,704 | 4/1934 | Kraus | 415/206 |
| 3,170,646 | 2/1965 | Springer | 415/121.3 |
| 3,444,869 | 5/1969 | Guignon et al. | 134/181 |
| 3,708,239 | 1/1973 | Stahle | 415/206 |
| 4,672,988 | 6/1987 | Tash | 134/172 |

*Primary Examiner*—Edward K. Look
*Assistant Examiner*—Mark Sgantzos

[57] ABSTRACT

A self-contained cleaning system for smoke exhausters comprising a bowl-shaped housing partially filled with cleaning fluid, and a sprayer tube rotatably secured in a central position within the housing having an upper portion and a lower portion. A plurality of upwardly aligned spout tubes are radially disposed on the upper portion of the sprayer tube, with the lower end of the sprayer tube having a beveled entrance and crescent-shaped apertures formed in proximity thereto. The housing can be mounted under a fan opening of the smole exhauster by engaging securing appendages therein with a wire grid grill covering the fan opening, and the upper end of the sprayer tube coupled to the hub of the fan by a coupling provided thereon. Upon the actuation of the fan, the rotatiton of the sprayer tube causes cleaning fluid to be drawn up the interior thereof, through the entrance and apertures on the lower portion, and to discharge from the spout tubes to clean the fan and parts of the smoke exhauster in communication therewith.

23 Claims, 5 Drawing Sheets

SELF-CONTAINED CLEANING SYSTEM FOR SMOKE EXHAUSTERS

BACKGROUND OF THE INVENTION

The present invention relates to a cleaning system for smoke exhausters, and more particularly to a self-contained cleaning system that can be quickly mounted under a fan opening of the smoke exhauster and automatically cleans the fan, fan housing, and other members of the smoke exhauster in and around the fan opening.

The cleaning of the fans of a smoke exhauster along with the fan housings, grill covers, and other related members thereabout, is tedious, time consuming, and distasteful work which usually requires a worker to stand on an elevated platform and manually clean the above mentioned components with a hand sprayer.

The grill cover is usually removed and cleaned separately while the fan blades are repeatedly manipulated to clean the portions of the fan housing or air ducts obstructed therebehind.

Further, the cleaning residues as a matter of course drain downwards and onto the range or other cooking device disposed under the smoke exhauster. Even when a cover or container is disposed thereunder, some residues are inevitably scattered over a wider area. Moreover, the worker is unavoidably drenched with cleaning residues, further adding to the unpleasantness of the work.

The self-contained cleaning system of the present invention provides an efficient, automated alternative to the manual cleaning process.

The cleaning system of the present invention provides a housing that can be filled with cleaning fluid and quickly mounted under a fan opening by a user. Upon actuation, the self-contained cleaning system automatically sprays jets of cleaning fluid onto the fan, fan housing, grill, and other related members thereabout to affect their cleaning. Cleaning residues are entirely contained within the housing during the cleaning procedure with the cleaning fluid draining back into the housing to be recycled.

Furthermore, the actuating power of the cleaning system can be derived from the fan motor itself, making for a very efficient and economical cleaning system.

Thus, the self-contained cleaning system of the present invention provides a rapid and automatic cleaning of the fans and other related components of a smoke exhauster without concomitant dirtying of the area in the vicinity thereof, and alleviates a user from a tiresome and distasteful chore.

SUMMARY OF THE INVENTION

The self-contained cleaning system for smoke exhausters has a primary objective of providing a self-contained cleaning system for smoke exhausters that can automatically and rapidly clean a fan, fan housing, and related members of a smoke exhauster, and that can be quickly mounted or removed from thereunder and cleans with a minimum of mess or spillage.

The self-contained cleaning system of the present invention comprises a generally bowl-shaped housing and a sprayer tube rotatably secured in a central position therein.

The sprayer tube has an upper portion and a lower portion. The lower portion thereof has beveled entrance formed on its lower end and a pair of roughly crescent-shaped apertures formed in proximity therewith.

The upper end of the sprayer tube has coupling provisions for coupling the rotation of a fan, to which the self-contained cleaning system is mounted thereunder, with the sprayer tube.

The coupling provision can be in the form of screw threading formed on the upper end of the sprayer tube which engages the mating threads of a receiving portion provided on the center of the fan hub.

A pair of elongated securing appendages are formed on the inner wall of the housing. Each securing appendage has a recess formed near the free, upper end thereof.

The housing can be releasably secured the fan opening of a smoke exhauster by engaging the recesses of the respective securing appendages with a corresponding wire of a wire grid grill covering the fan opening. This can be accomplished by positioning the housing under the fan opening and rotating it slightly so that corresponding wires of the grill come to rest within the recesses on respective securing appendages.

With the housing, being partially filled with cleaning fluid, so mounted under a fan opening of a smoke exhauster and with the sprayer tube therein coupled to the fan, a user can actuate the fan motor of the smoke exhauster to begin automatic cleaning of the fan and other members of the smoke exhauster in communication therewith.

The concomitant rotation of the sprayer tube causes cleaning fluid to be drawn up the sprayer tube through the beveled entrance and apertures thereon.

Cleaning fluid flows up towards the upper portion of the sprayer tube where the cleaning fluid is forcibly discharged by a plurality of upwardly aligned and radially disposed spout tubes provided thereon.

The upwardly directed jets of cleaning fluid wash the blades of the fan, the portions of the air duct immediately above the fan, and other related members in proximity therewith.

All cleaning residues drain back into the housing without any spillage of residues onto the areas below the smoke exhauster.

A sealing ring is provided on the rim of the housing which is forced against the lower surface of the smoke exhauster by the reduced air pressure within the housing created by the action of the fan.

This forms an air tight seal which eliminates the possibility of leakage of cleaning fluid from the housing.

The reduced air pressure in the housing also causes a compressible, roughly bulb-shaped chamber, provided on the bottom portion of the housing and in communication with the interior thereof, to compress.

This action raises the level of cleaning fluid within the housing and aids the flow of cleaning fluid up the sprayer tube.

After the cleaning action is complete, which takes much less time than with a manual cleaning, the fan motor is switched off and the housing removed from under the fan opening by rotating the housing in an opposite direction to disengage the securing appendages therein from the wire grid grill cover. The air pressure within the housing returns to normal upon deactivation of the fan motor, so that the removal of the housing is not impeded.

Moreover, the continued inertial rotation of the fan after deactivation of the fan motor serves to slough off residual cleaning fluid on the blades thereof and causes sufficient turbulence to significantly dry off the other cleaned members within and around the fan opening.

As such, the spillage of cleaning residues from the fan opening of the smoke exhauster, even after the removal of the self-contained cleaning system, is indeed minimal.

In an alternate embodiment of the self-contained cleaning system of the present invention, an electric motor is disposed within an enclosure provided below the housing in place of the compressible chamber of the prior embodiment.

The electric motor rotates the sprayer tube, with the shaft thereof being coupled to the lower end of the sprayer tube.

In place of the beveled entrance and crescent-shaped apertures on the sprayer tube of the prior embodiment, an elongate helically-shaped slot is formed on the lower portion of the sprayer tube of the alternate embodiment, and functions similarly to draw cleaning fluid up the interior thereof.

Jets of cleaning fluid are discharged from a plurality of spout tubes disposed on the upper portion of the sprayer tube as with the prior embodiment.

Similarly, the securing appendages within the housing are unchanged with mounting or removal of the housing being performed in similar fashion as with the prior embodiment.

As is readily apparent, the primary objective of the present invention has been accomplished. A detailed description of the structure and function of the self-contained cleaning system for smoke exhausters of the present invention is provided below along with accompanying drawings.

A BRIEF DESCRIPTION OF THE DRAWINGS

DESCRIPTION OF THE PREFERRED EMBODIMENTS

Figure 1:
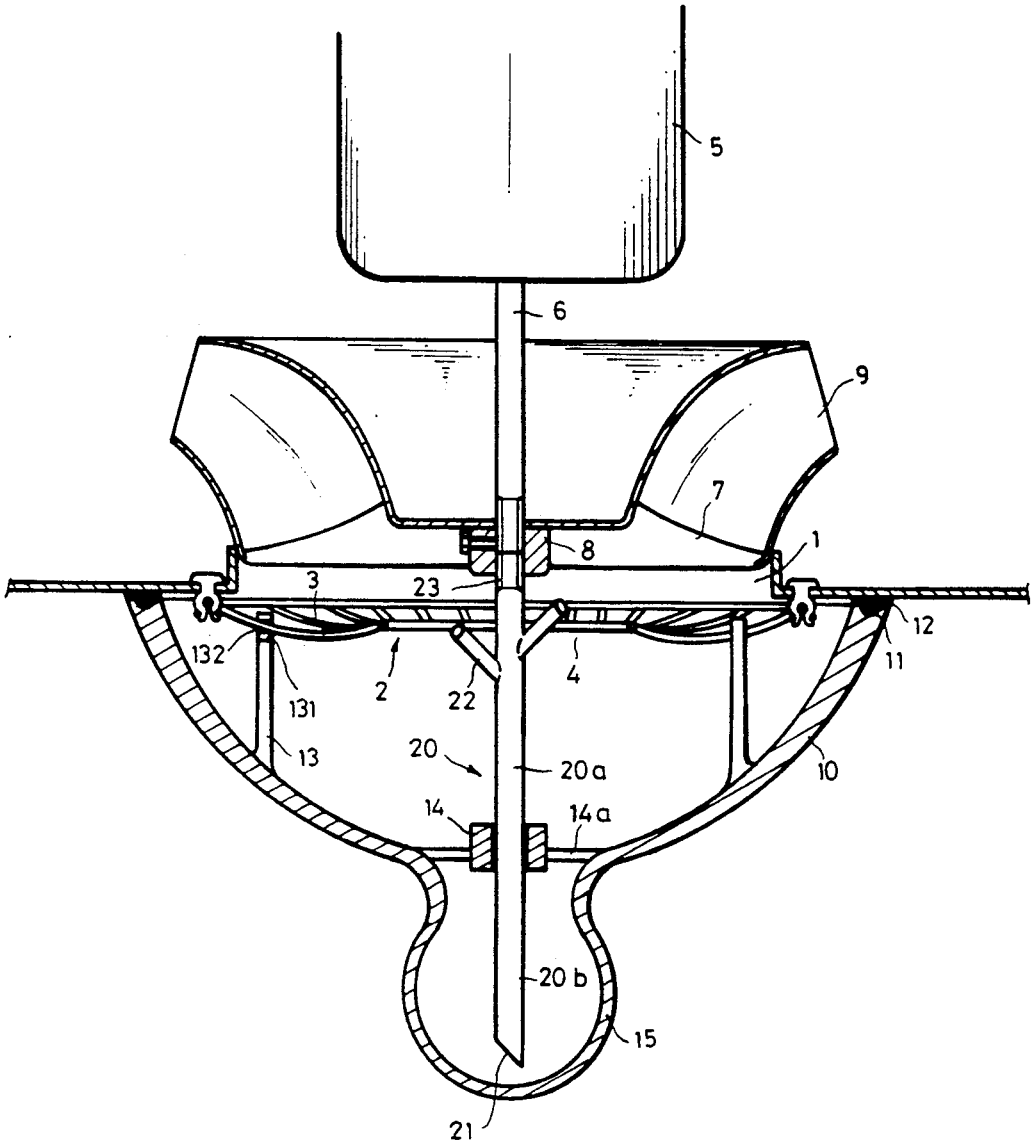
FIG. 1 is a partly sectional plan view of a first embodiment of the self-contained cleaning system for smoke exhausters of the present invention, mounted under a fan housing of a smoke exhauster.

Referring to FIG. 1, the self-contained cleaning system for smoke exhausters comprises a bowl-shaped housing 10 made from an elastic, plastic material, and an elongate sprayer tube 20 rotatably secured in a central position with housing 10 with an upper portion 20*a* and a lower portion 20*b*, which extends into a roughly bulb-shaped chamber 15 formed on the bottom of housing 10.

Sprayer tube 20 is rotatably secured to housing 10 by a plastic journal 14, rigidly connected to the inner wall of housing 10 by a set of radial connecting members 14*a*.

Figure 3:
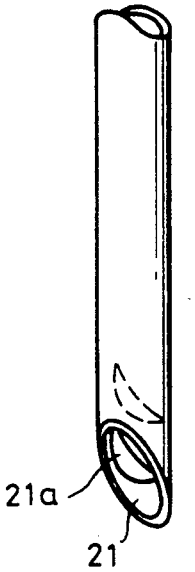
FIG. 3 is a side view of the lower end portion of a sprayer tube of a first embodiment of the self-contained cleaning system for smoke exhausters of the present invention.

Referring also to FIG. 3, the lower end of lower portion 20*b* of sprayer tube 20 has a beveled entrance 21 formed at an acute angle with respect to the longitudinal axis of sprayer tube 20. Two roughly crescent-shaped aperture 21*a* are also formed on lower portion 20*b* of sprayer tube 20, a small distance above entrance 21.

A plurality of spout tubes 22 are attached to upper portion 20*a* of sprayer tube 20 are pre-determined positions thereon. Each spout tube 22 extends laterally outwards in a radial direction from sprayer tube 20 and is upwardly aligned. The inner ends of each spout tube 22 is in communication with the interior of sprayer tube 20, and the outer ends thereof are unobstructed or possibly provided with spraying nozzles.

A pair of elongate securing appendages 13, aligned in a generally vertical direction, are formed with housing 10 with the lower terminal end of each said securing appendage 13 adjoining with the inner wall thereof.

Figure 4:
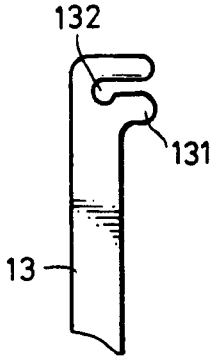
FIG. 4 is a side view of the upper end portion of a securing appendage of a housing of the self-contained cleaning system for smoke exhausters of the present invention.

Referring also to FIG. 4, a protruding lug 131 is formed on the upper terminal end of each securing appendage 13, with the protruding lug 131 of a first appendage 13 extending in a rearwards direction and the protruding lug 131 of a second appendage 13 extending in a forward direction.

A recess 132 is formed on the protruding face of each lug 131 on corresponding securing appendages 13.

An annular, pliant sealing ring 12 is disposed on the rim 11 of bowl-shaped housing 10.

When in use, housing 10 is mounted below a fan opening 1 of a smoke exhauster, comprising a fan 7 disposed immediately above fan opening 1, a motor 5 with a shaft 6 coupled to the hub 8 of fan 7, an air duct 9 enclosing fan 7, and a wire grid grill 2 covering fan opening 1.

Housing 10 is releasably secured under a fan opening 1 of a smoke exhauster by positioned the sealing ring 12 on rim 11 thereof against the lower surface of the smoke exhauster surrounding fan opening 1, and rotating housing 10 so that recesses 132 on respective lugs 131 therein engage corresponding cross wires 3 of grill 2, secured under fan opening 1.

Figure 2:
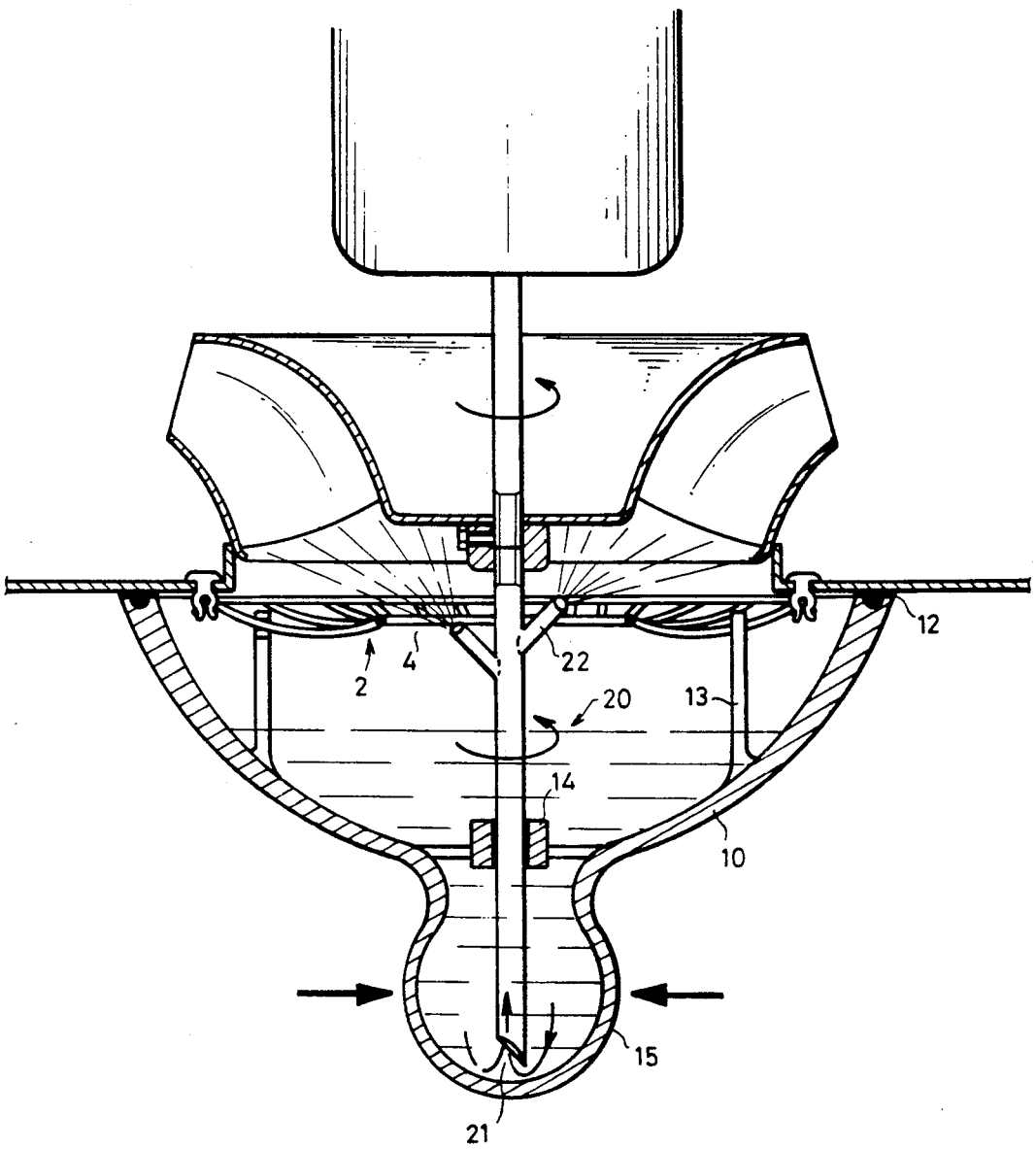
FIG. 2 is partly sectional plan view of a first embodiment of the self-contained cleaning system for smoke exhausters of the present invention, mounted under a fan housing of a smoke exhauster and depicting the operation of the self-contained cleaning system.

In embodiment shown in FIGS. 1 and 2, prior to the mounting of housing 10, sprayer tube 20 is first coupled with the hub 8 of fan 7 by engaging the threaded upper end 23 thereof with mating threads formed in a receiving portion in the center of hub 8.

Housing 10, partially filled with cleaning fluid, can then be mounted under fan opening 1 of the smoke exhauster as described with the lower portion 20*b* of sprayer tube 20 being inserted through journal 14 therewithin, as shown in FIG. 2.

Referring to FIG. 2, in operation, actuation of the fan motor 5 by a user causes the concomitant rotation of sprayer tube 20 along with fan 7 coupled therewith.

The rotating beveled entrance 21 and the crescent-shaped apertures 21*a* on the lower portion 20*b* of sprayer tube 20 cause the cleaning fluid to swirl in vortexes within the interior of sprayer tube 20, and thereby draws cleaning fluid up sprayer tube 20.

The cleaning fluid flows upwards towards the upper portion 20*a* of sprayer tube 20 and is then forcibly discharged through the plurality of upwardly aligned spout tubes 22 thereon, towards the fan opening 1 of the smoke exhauster to clean the members thereabout in communication with fan opening 1, including the blades of fan 7, grill 2, and the portions of air duct 9 immediately above fan 7.

The centripetal impulse imparted to the cleaning fluid by the rotating and radially extending spout tubes 22 further increases the strength of the cleaning jets or sprays issuing therefrom.

The rotating fan 7 also causes a region of reduced air pressure to be created within housing 10. The relatively greater ambient air pressure forces housing 10 against the lower surface of the smoke exhauster, with sealing ring 12 thereon forming an airtight seal between housing 10 and the lower surface of the smoke exhauster.

The ambient air pressure also causes chamber 15 which has a wall thickness less than that of housing 10 to compress and augment the flow of cleaning fluid up sprayer tube 20 by raising the level of the cleaning fluid within housing 10.

Spent cleaning fluid drains back into housing 10 and is re-used with no spillage escaping therefrom.

Housing 10, adjoining chamber 15, and securing appendage 13 and journal 14 therein, along with connecting members 14*a*, can be manufactured as an integral, single-piece construction by molding from a synthetic material of suitable characteristics. As such, the above mentioned members, as well as the metallic sprayer tube 20, can be produced inexpensively by largely automated processes with very simple assembly.

Figure 5:
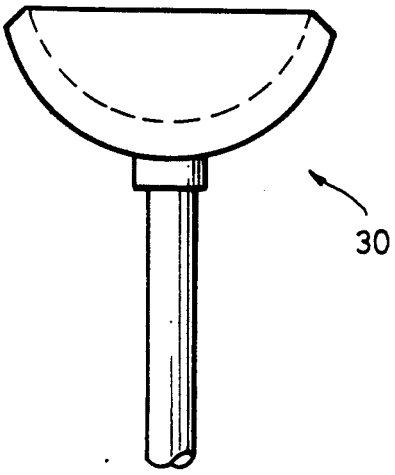
FIG. 5 is a side view of a suction cap secured to the upper end of a sprayer tube of a first embodiment of the self-contained cleaning system for smoke exhausters of the present invention.
Figure 6:
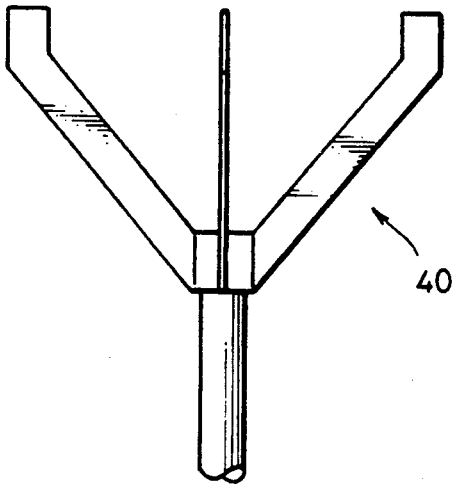
FIG. 6 is a side view of a set of engaging vanes secured to the upper end of a sprayer tube of a first embodiment of the self-contained cleaning system for smoke exhausters of the present invention.

Referring to FIGS. 5 and 6, sprayer tube 20 can be readily coupled to the fans of smoke exhausters whose fan hubs are not provided with integral receiving portions for coupling therewith.

In one variation, as shown in FIG. 5, a suction cap 30 made from a pliant, elastic material and with a predetermined shape and dimensions is secured to the upper end of sprayer tube 20.

The upper end of sprayer tube 20 can be forced against the center of the hub of a fan so that suction cap 30 flattens against the lower surface of the hub, expunging the air therebetween, and effectively coupling sprayer tube 20 to the hub of the fan by suction.

In a second variation, as shown in FIG. 6, a plurality of elongate engaging vanes 40 are radially disposed on the upper end of sprayer tube 20 with the inner ends thereof rigidly secured thereon.

Engaging vanes 40 are upwardly aligned and have span less than the diameter of a central opening 4 of a grill 2, shown in FIGS. 1 and 2, so that the engaging vanes 40 can pass therethrough when sprayer tube 20 is positioned under a fan, the upper portion of each engaging vane 40 abuts a corresponding blade of the fan to couple the rotation thereof with sprayer tube 20.

Unlike the sprayer tube 20 with a threaded upper end 23, as described above, a sprayer tube 20 using either of the latter coupling methods does no require separate assembly onto a fan 7 prior to the mounting of housing 10 thereunder. A sprayer tube 20 with either suction cap 30 or engagement vanes 40 secured onto the upper end thereof can be positioned within housing 10 by journal 154 and simultaneously positioned under a fan opening 1 along with housing 10.

Figure 7:
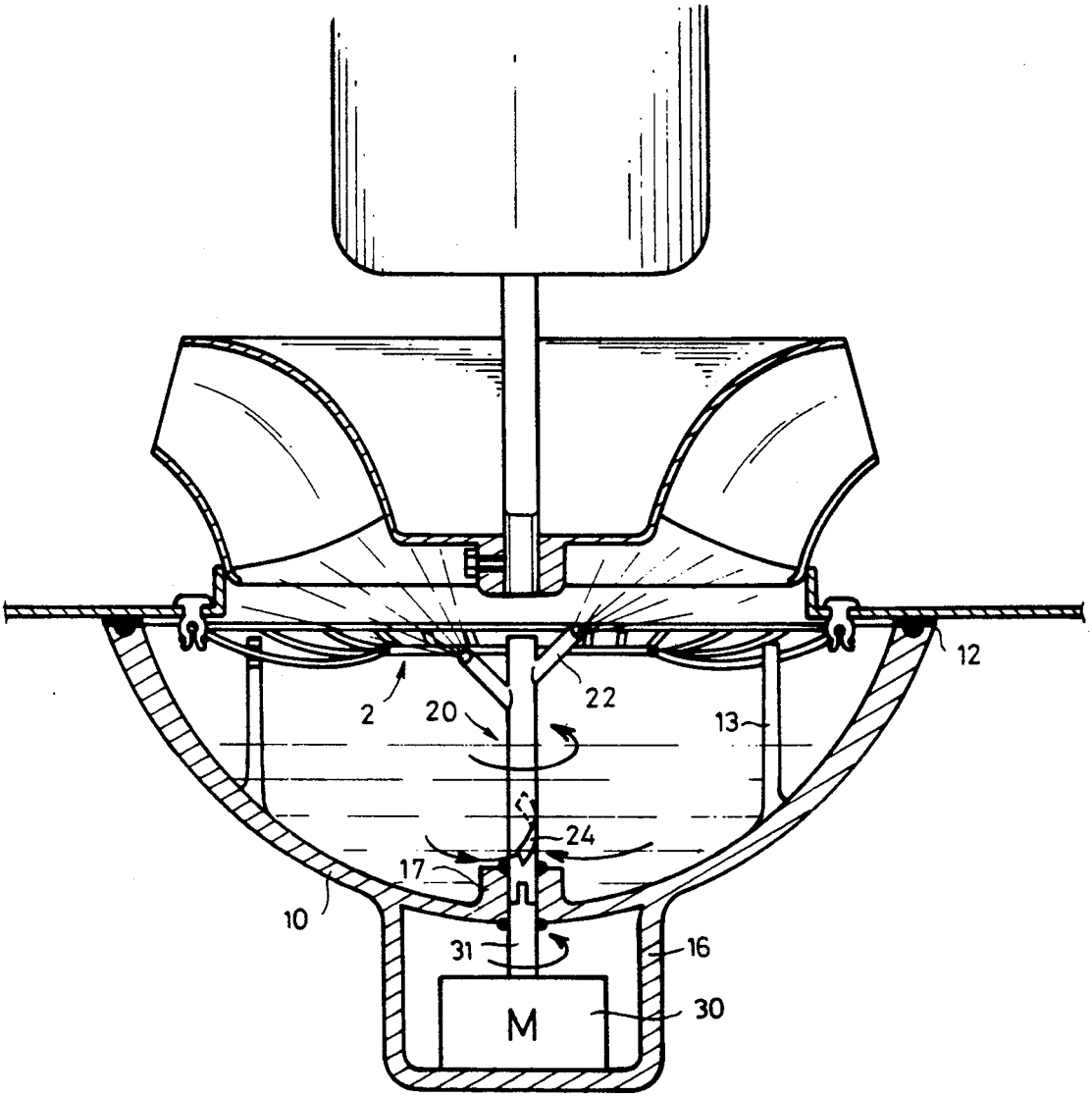
FIG. 7 is a partly sectional plane view of an alternate embodiment of the self-contained cleaning system for smoke exhausters of the present invention.

Referring to FIG. 7, in an alternate embodiment of the self-contained cleaning system of the present invention, an electric motor 30 is disposed within an enclosure 16 formed on the bottom portion of a housing 10'.

Sprayer tube 20' has been modified and is coupled to the output shaft 31 of motor 30 on the lower end thereof, there being no coupling provisions on the upper end thereof for coupling to a fan 7.

Output shaft 31 and the lower end of sprayer tube 20' are enclosed in a journal 17 formed on the bottommost portions of the interior of housing 10' above enclosure 16, which is provided with a pair of sealing rings to prevent the leakage of cleaning fluid therefrom into motor enclosure 16.

Motor 30 can be powered by batteries stored in enclosure 16 (not shown) or by an A.C. power mains through an external extension cord.

An elongated, helically-shaped slot 24 is formed on the lower portion of sprayer tube 20', above journal 17.

Spout tubes 22 provided on the upper portion of sprayer tube 20' are unchanged from those of sprayer tube 20 of the first embodiment. Similarly, securing appendages 13 and sealing ring 12 of housing 10' are unchanged from those of housing 10.

Housing 10' is mounted under a fan opening 1 in the same fashion as with housing 10. When a user actuated motor 30, causing the concomitant rotation of sprayer tube 20', the rotation of helically-shaped slot 24 creates swirling vortexes of cleaning fluid to form within the interior of sprayer tube 20', drawing cleaning fluid up towards spout tubes 22 to be forcibly discharged therefrom.

Housing 10', securing appendages 13 therein, and adjoining enclosure 16 can also be formed as an integral, single-piece construction by molding from an elastic synthetic material of suitable characteristics.

A structure of a smoke exhauster could also be specially designed to receive a cleaning system, as described, particularly adapted for use therewith so as to optimize the cleaning effect and facilitate its application.

As examples, the lower surface of a smoke exhauster could be modified so as to facilitate the mounting of a particularly adapted cleaning system thereon, or the structure of a fan hub therein could be modified to facilitate the coupling of a sprayer tube of the cleaning system.

Similarly, the spout tube assembly of the sprayer tube could be arranged so as to optimize the cleaning of a fan and fan housing of a specific geometry.

It is thus readily apparent that many variations and modifications to the self-contained cleaning system of the present invention would occur to one skilled in the art.

As such, through the disclosure given above contains many specificities, these should not be interpreted as limitations on the scope of the present invention, but merely as one mode of actualization of the preferred embodiments thereof.

Rather, the actual scope and spirit of the present invention should be inferred from the appended claims and their legal equivalents.

I claim:

1. A self contained cleaning system for a smoke exhauster comprising:

a generally bowl shaped housing partially filled with cleaning fluid;

securing means provided on said housing for releasably securing said housing under a fan opening of said smoke exhauster;

a sprayer tube with an upper portion and a lower portion rotatably secured in a central position within said housing;

a suction means provided on said sprayer tube;

a spout means provided on said upper portion of said sprayer tube for spraying said cleaning fluid into said fan opening of said smoke exhauster;

a coupling means provided on the upper end of said sprayer tube for coupling said sprayer tube to the rotation of a corresponding fan of said smoke exhauster;

whereby, with said self contained cleaning system releasably secured under said fan opening and said fan is actuated, the rotating said sprayer tube sprays said cleaning fluid into said fan opening and cleans the portions of said smoke exhauster in communication therewith.

2. A self contained cleaning system according to claim 1, further comprising an annular sealing ring, made from a pliant material provided on the rim of said bowl shaped housing to form an air tight seal between said housing and the lower surface of said smoke exhauster when said self contained cleaning system is mounted thereunder.

3. A self contained cleaning system for a smoke exhauster according to claim 2 further comprising:

a chamber, compressible under the action of ambient air pressure when said self contained cleaning system is in operation, provided on the lower portion of said housing and in communication with the interior thereof;

wherein, said suction means on said lower portion of said sprayer tube extends into said cavity, with the compression of said chamber due to reduced relative pressure within the interior of said housing caused by the rotation of said fan aiding the flow of said cleaning fluid up said sprayer tube.

4. A self contained cleaning system for a smoke exhauster according to claim 3, wherein said chamber comprises a generally bulb shaped extension formed on the bottom of said housing, with a wall thickness less than that of said housing.

5. A self contained cleaning system according to claim 1, wherein said securing means comprises two or more elongated appendages, with a first terminal end of each said appendage adjoined with the inner wall of said housing at a predetermined position therein, and a second terminal end of each said appendage having a recess formed in proximity thereto for engaging a corresponding wire of wire grid grill attached over said fan opening.

6. A self contained cleaning system according to claims 4 or 5, wherein said housing, said bulb shaped extension of said chamber and said appendages of said securing means are of single piece integral construction formed by molding of an elastic synthetic material.

7. A self contained cleaning system according to claim 1, wherein said suction means of said sprayer tube comprises a beveled entrance formed on the lower end thereof with at least one generally crescent shaped aperture formed in proximity therewith on said sprayer tube.

8. A self contained cleaning system according to claim 1, wherein said spout means of said sprayer tube comprises a plurality of spout tubes disposed at predetermined positions on said sprayer tube and extending radially outwards therefrom, with each said spout tube being upwardly aligned and the inner end thereof in communication with the interior of said sprayer tube.

9. A self contained cleaning system according to claim 1, wherein said coupling means of said sprayer tube comprises a threaded portion provided on the upper end thereof which can be engaged with mating threads formed on a receiving portion disposed on the center of the hub of said fan.

10. A self contained cleaning system according to claim 1, wherein said coupling means of said sprayer tube comprises a set of elongate engaging members disposed on the upper end thereof and extending radially outwards therefrom, with each said engaging member being upwardly aligned and the upper portion thereof abutting a blade of said fan, to couple the rotation of said fan with said sprayer tube.

11. A self contained cleaning system according to claim 1, wherein said coupling means of said sprayer tube comprises a suction cap of predetermined shape disposed on the upper end thereof, whereby said suction cap can be forced against the lower portion of the hub of said fan to couple said sprayer tube therewith.

12. A self contained cleaning system for smoke exhausters comprising:

a generally bowl shaped housing partially filled with cleaning fluid;

securing means provided on said housing for releasably securing said housing under a fan opening of said smoke exhauster;

a sprayer tube with an upper portion and a lower portion rotatably secured in a central position within said housing;

a suction means provided on said lower portion of said sprayer tube for drawing said cleaning fluid up said sprayer tube;

a spout means provided on said upper portion of said sprayer tube for spraying said cleaning fluid into said fan opening of aid smoke exhauster;

an electric motor whose shaft is rotatingly engaged with said sprayer tube;

whereby, with said self contained cleaning system releasably secured under said fan opening and said fan is actuated, the rotating said sprayer tube sprays said cleaning fluid into said fan opening and cleans the portions of said smoke exhauster in communication therewith.

13. A self contained cleaning system for smoke exhausters according to claim 12, wherein said electric motor is disposed within an enclosure provided below said housing.

14. A self container cleaning system according to claim 12, further comprising an annular sealing ring, made from a pliant material, provided on the rim of said bowl shaped housing to form an air tight seal between said housing and the lower surface of said smoke exhauster when said self contained cleaning system is mounted thereunder.

15. A self contained cleaning system according to claim 12, wherein said securing means comprises two or more elongate appendages, with a first terminal end of each said appendage adjoined with the inner wall of said housing at a predetermined position therein, and a second terminal end of each said appendage having a recess formed in proximity thereto for engaging a corresponding wire of a wire grid grill attached over said fan opening.

16. A self contained cleaning system according to claim 13 or 15, wherein said housing, said enclosure for said motor, and said appendages of said securing means are of single piece integral construction formed by molding of an elastic synthetic material.

17. A self contained cleaning system for smoke exhausters according to claim 12, wherein said suction means comprises at least one elongate, helically shaped slot formed on the lower portion of said sprayer tube.

18. A self contained cleaning system according to claim 12, wherein said spout means of said sprayer tube comprises a plurality of a spout tubes disposed at predetermined positions on said sprayer tube and extending radially outwards therefrom, with each said spout tube being upwardly aligned and the inner end thereof in communication with the interior of said sprayer tube.

19. A smoke exhauster provided with a cleaning system comprising:

a generally bowl shaped housing provided with cleaning fluid;

securing means provided on said housing for releasably securing said housing under a fan opening of said smoke exhauster;

a sprayer tube with an upper portion and a lower portion rotatably secured in a central position within said housing;

a suction means provided on said lower portion of said sprayer tube for drawing said cleaning fluid up said sprayer tube;

a spout means provided on said upper portion of said sprayer tube for spraying said cleaning fluid into said fan opening of said smoke exhauster;

a coupling means provided on the upper end of said sprayer tube for coupling said sprayer tube to the rotation of a corresponding said fan of said smoke exhauster;

whereby, with said cleaning system releasably secured under said fan opening and said fan is actuated, the rotating said sprayer tube sprays said cleaning fluid into said fan opening and cleans the portions of said smoke exhauster in communication therewith.

20. A smoke exhauster provided with cleaning system according to claim 19, further comprising an annular sealing ring, made from a pliant material, provided on the rim of said bowl shaped housing to form an air tight seal between said housing and the lower surface of said smoke exhauster when said self contained cleaning system is mounted thereunder.

21. A smoke exhauster provided with cleaning system according to claim 19, further comprising:

a chamber, compressible under the action of ambient air pressure when said self contained cleaning system is in operation, provided on the lower portion of said housing and in communication with the interior thereof;

wherein, said suction means on said lower portion of said sprayer tube extends into said cavity, with the compression of said chamber due to reduced relative pressure within the interior of said housing caused by the rotation of said fan aiding the flow of said cleaning fluid up said sprayer tube.

22. A smoke exhauster provided with cleaning system according to claim 19, wherein said suction means of said sprayer tube comprises a beveled entrance formed on the lower end thereof with at least one generally crescent shaped aperture formed in proximity therewith on said sprayer tube.

23. A smoke exhauster provided with cleaning system according to claim 19, wherein said spout means of said sprayer tube comprises a plurality of spout tubes disposed at predetermined positions on said sprayer tube and extending radially outwards therefrom, with each said spout tube being upwardly aligned and the inner end thereof in communication with the interior of said sprayer tube.

* * * * *